US006306006B1

(12) United States Patent
Cheng

(10) Patent No.: US 6,306,006 B1
(45) Date of Patent: Oct. 23, 2001

(54) BRASSIERE PAD

(75) Inventor: Hsi-Chuan Cheng, Tainan (TW)

(73) Assignee: Wei Sheng Fabric Enterprise Co., Ltd., Tainan (TW)

( * ) Notice: Subject to any disclaimer, the term of this patent is extended or adjusted under 35 U.S.C. 154(b) by 0 days.

(21) Appl. No.: 09/520,979

(22) Filed: Mar. 8, 2000

(51) Int. Cl.[7] ..... A41C 3/00

(52) U.S. Cl. ..... 450/57; 450/58; 2/267

(58) Field of Search ..... 450/57, 58; 2/267, 2/268

(56) References Cited

U.S. PATENT DOCUMENTS

| | | | | |
|---|---|---|---|---|
| 532,756 | * | 1/1895 | Bergheim | 450/57 |
| 810,332 | * | 1/1906 | Grean | 2/267 |
| 2,068,644 | * | 1/1937 | Frais | 2/267 |
| 2,616,093 | * | 11/1952 | Talalay | 450/57 |
| 2,864,373 | * | 12/1958 | Buckley | 450/57 |
| 5,361,410 | * | 11/1994 | Sigl | 2/267 |

* cited by examiner

*Primary Examiner*—Gloria M. Hale
(74) *Attorney, Agent, or Firm*—Rosenberg, Klein & Lee

(57) ABSTRACT

A brassiere pad includes a pad body having a preset shape and many air holes communicating with an upper and a lower surface, and a piece of surface cloth adhered to the upper and the lower surface, permitting a brassiere with the pad having a very airy condition to wear comfortably.

5 Claims, 3 Drawing Sheets

BRASSIERE PAD

BACKGROUND OF THE INVENTION

This invention relates to a brassiere pad. particularly to one having a pad body with many air holes communicating with an upper and a lower surface to be provided with good airy condition.

Known conventional brassieres shown in FIG. 3 have a cup body 10 for containing a pad 20, which consists of a pad body 201 and a piece of surface cloth 202 made of silk and cotton adhered on the pad body 201. The pad body 201 is soft and a little swelling and the surface cloth 202 is also porous to let a conventional brassiere provided with an airy condition.

Although the conventional brassiere pad has the surface cloth 202 made of silk and cotton to be provided with good sweat sucking effect and an airy condition, but the main factor of good airy condition is dependent on the pad body 201 having a good airy condition or not. As the conventional pads are soft and somewhat swelling, their molecules are not so widely scattered, resulting in not so good airy condition. Wearers of the conventional brassieres may feel sultry and may grow freckles if worse.

SUMMARY OF THE INVENTION

This invention has been devised to offer a brassiere pad provided with many air holes communicating with an upper and a loner surface of the pad with a layer of silk and cotton respectively adhered on the upper and the lower surfaces of the pad, permitting the brassiere have a good airy condition.

BRIEF DESCRIPTION OF DRAWING

The invention will be better understood by referring to the accompanying drawings, wherein.

DETAILED DESCRIPTION OF THE PREFERRED EMBODIMENT

Figure 1:
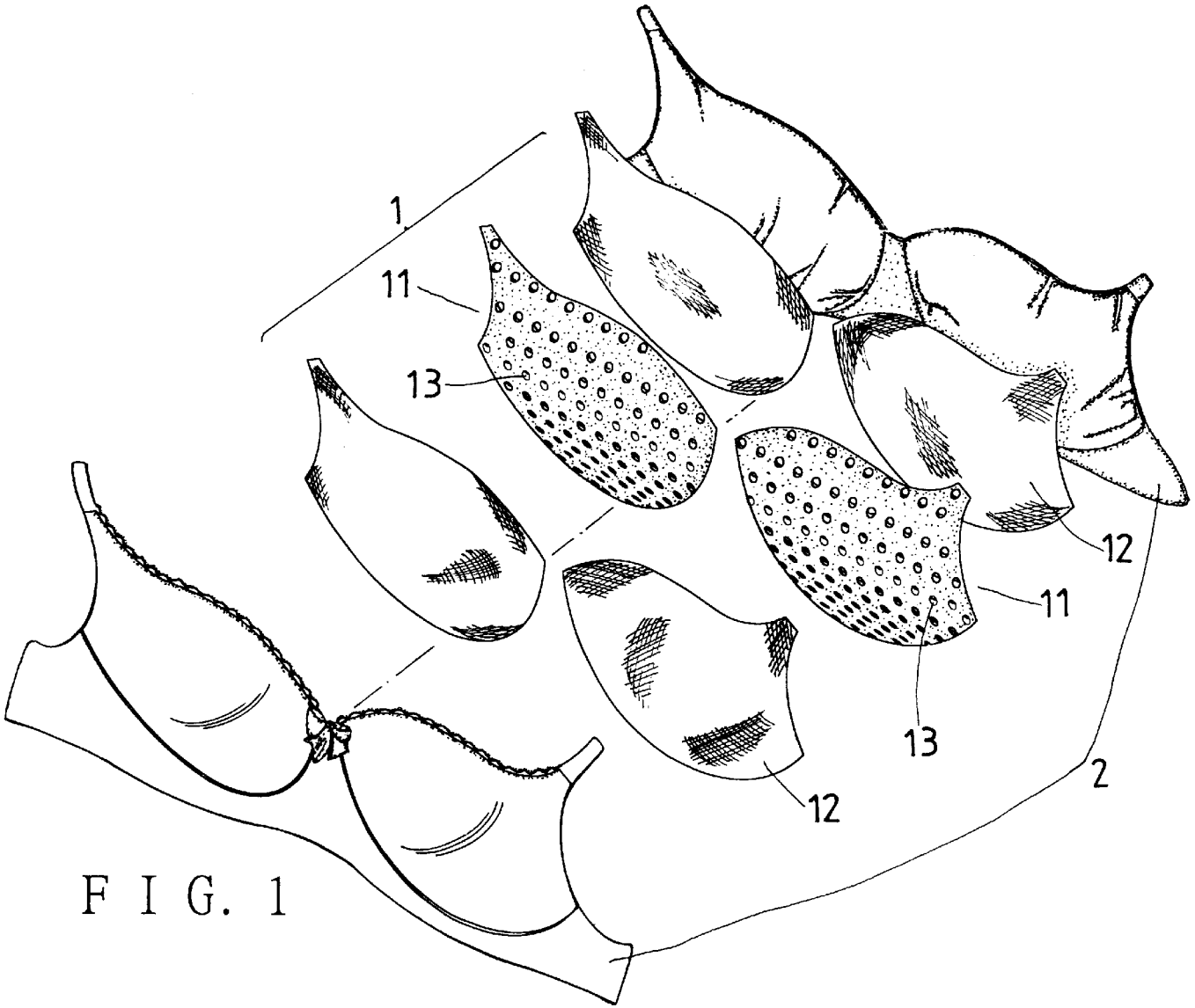
FIG. 1 is an exploded perspective view of a brassiere pad of the present invention.
Figure 2:
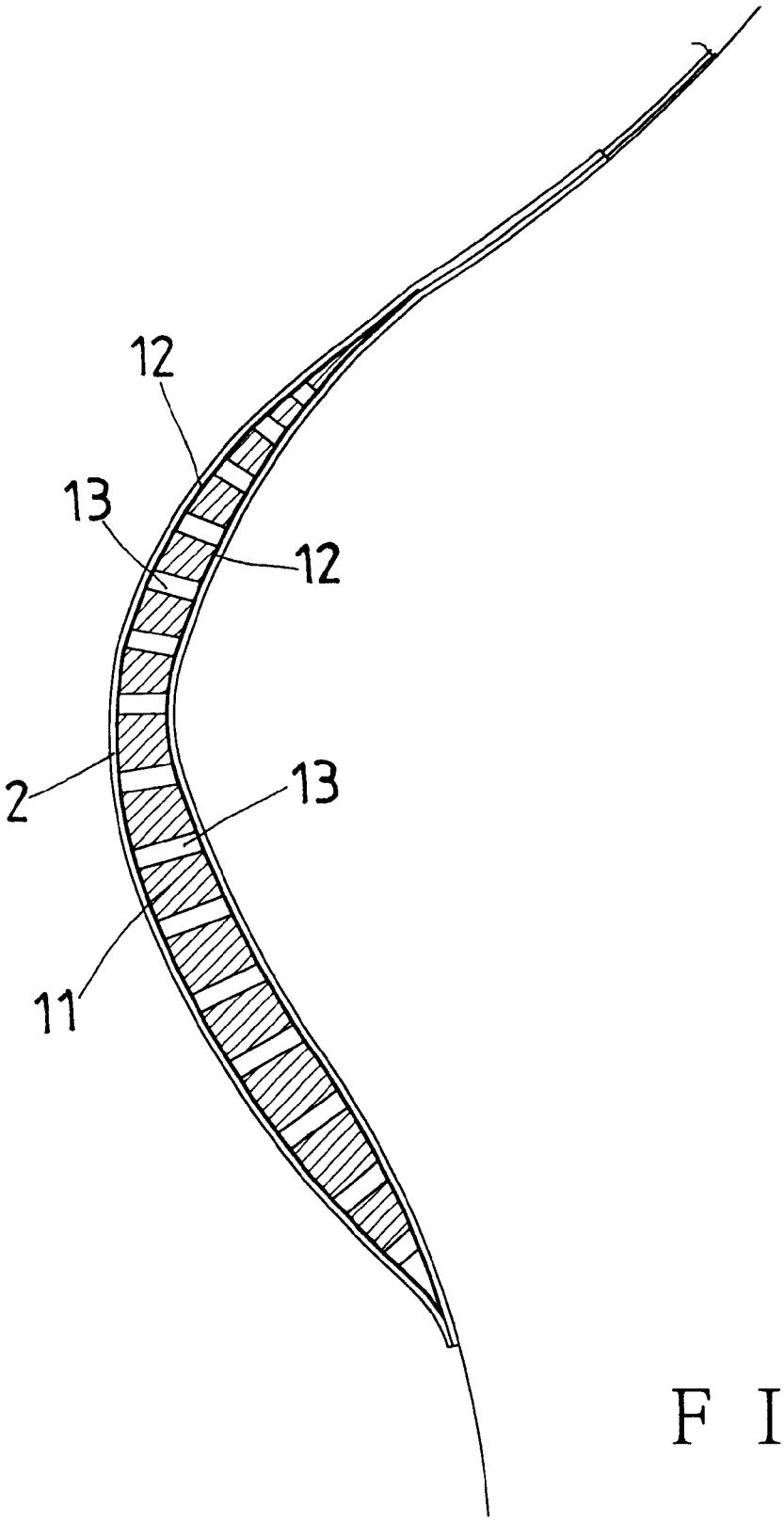
FIG. 2 is a cross-sectional view of the brassiere pad placed in a cup of the present invention.
Figure 3:
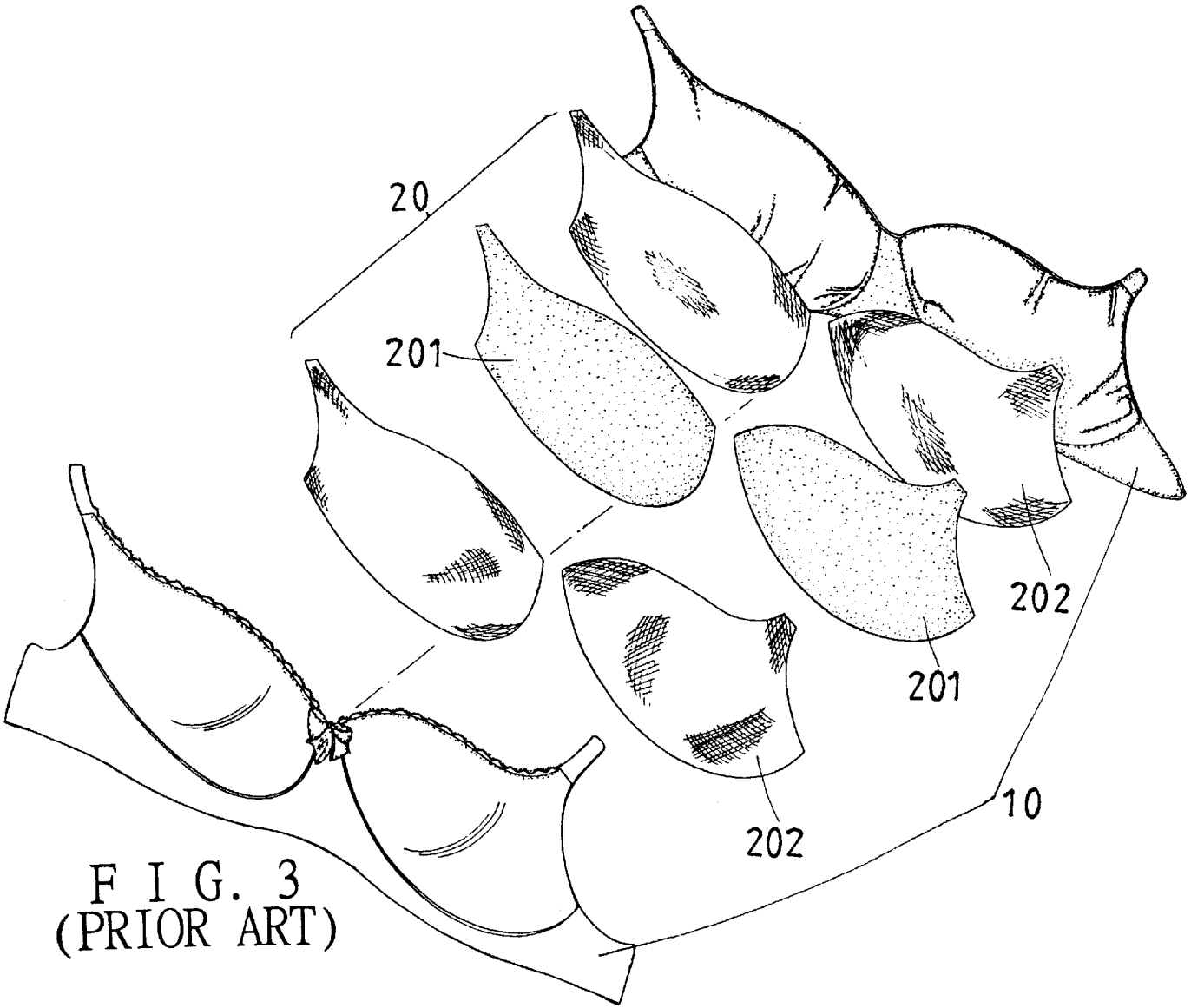
FIG. 3 (PRIOR ART)
FIG. 3 is known conventional brassieres with a pad contained in a cup.

A preferred embodiment of a brassiere pad 1 of the present invention, as shown in FIGS. 1 and 2, includes a pad body 11 of a preset shape and of many air holes 13 communicating with an upper and a lower surface. Then a piece of surface cloth 12 made of silk and cotton is respectively adhered on the upper and the lower surface of the pad body 11. The pad 1 is placed in a cup 2 to finish assemblage of the brassiere with a good airy condition in the invention.

The pad body 1 may be made of foam material of a light weight and good elasticity, or made of comparatively thin and elastic silk and cotton. The pad body 1 may be applied to a cup to be contained therein as integral (i. e. non-stitching line brassieres) or stitching line ones. In addition to the airy condition of the surface cloth and the pad body. The pad body has many air holes communicating with the upper and the lower surface to let the pad provided with the best airy condition. Besides, the pad itself may not disfigure, so after it is placed in a cup, it become a very airy brassiere to wear comfortably, with a beautiful appearance.

What is claimed is:

1. A brassiere pad, comprising:

a pad body made of an integral single layer piece of elastic material having front and rear surfaces thereof, said pad body having a plurality of ventilation holes formed through said integral single layer piece of elastic material, each said ventilation hole having smoothly shaped walls thereof extending between said front and rear surfaces and forming air passage of substantially constant cross-section along the length of said air passage; and a surface cloth attached to said front and rear surfaces of said pad body.

2. The brassiere pad as claimed in claim 1, wherein said pad body is made of an elastic foam material of a light weight.

3. The brassiere pad as claimed in claim 1, wherein said pad body is made of elastic silk or cotton.

4. The brassiere pad as claimed in claim 1, wherein said pad body is attachable to a non-stitching line brassiere.

5. The brassiere pad as claimed in claim 1, wherein said pad body is attachable to a stitched brassiere.

* * * * *